United States Patent [19]

Parker

[11] Patent Number: 4,680,794

[45] Date of Patent: Jul. 14, 1987

[54] AM STEREO SYSTEM WITH MODIFIED SPECTRUM

[75] Inventor: Norman W. Parker, Wheaton, Ill.

[73] Assignee: Motorola, Inc., Schaumburg, Ill.

[21] Appl. No.: 891,496

[22] Filed: Jul. 29, 1986

[51] Int. Cl.[4] ..... H04H 5/00

[52] U.S. Cl. ..... 381/15; 381/16

[58] Field of Search ..... 381/15, 16; 332/23 A

[56] References Cited

U.S. PATENT DOCUMENTS 4,192,968 3/1980 Hilbert et al. ..... 381/15

4,332,978 6/1982 Streeter ..... 381/15

4,371,747 2/1983 Hilbert ..... 381/15

4,377,728 3/1983 Hilbert ..... 381/15

*Primary Examiner*—Forester W. Isen

*Attorney, Agent, or Firm*—Margaret Marsh Parker

[57] ABSTRACT

The correction signal of the AM stereo system is filtered through a lowpass filter thus providing compatible signals at all normal modulation levels and frequencies, but allowing the signal to become pure quadrature at high frequency, high modulation levels. The inverse of the process can be utilized in the receivers if desired. The improvement is needed only for narrow channel or restricted sideband broadcasting.

18 Claims, 9 Drawing Figures

10
16
12
(1+L+R)
14
(L−R)
MODULATOR
ADDER
MODULATOR
18
19
π/2
QUAM
20
SYNCHRONOUS DETECTOR
32
COS ϕ
LOW PASS FILTER
34
HIGH LEVEL MODULATOR
24
C−QUAM OR QUAM
(1+L+R) OR A
ENVELOPE DETECTOR
26
DELAY
28
MULTIPLIER
30
−Σ
36
D.C.

AM STEREO SYSTEM WITH MODIFIED SPECTRUM

BACKGROUND OF THE INVENTION

This invention relates to the field of AM stereo broadcasting and, more particularly, to a system wherein the high frequency modulating signals are modified before transmission and restored after reception.

The ideal AM stereo signal is pure quadrature but since the envelope of any AM broadcast signal is required to be compatible with present monophonic receivers (1+L+R), pure quadrature cannot be used on the broadcast band. One system for transmitting two information signals on a single amplitude modulated carrier with no distortion in monophonic receivers was disclosed in a U.S. Pat. No. 4,218,586, assigned to the assignee of the present invention. In this system the envelope is always 1+L+R, the monophonic signal, and the instantaneous phase angle $\phi$ is the arc tangent of [(L−R)/(1+L+R)]. This system is termed C-QUAM TM (compatible quadrature amplitude modulation). In stereophonic receivers a correction signal having the value cosine $\phi$ is used to recover the original audio signals. This system is completely satisfactory for all normal program material but it is possible for extreme program conditions to cause a slight increase in adjacent channel interference. An example would be the transmission of a high frequency signal in one channel only with a high modulation level, an unlikely situation in actual programming. Naturally, the problem is more likely to arise in countries that use narrow interchannel spacings or where the allowable radiation is severely restricted with regard to the presence of sideband components above the highest audio frequency.

Attempts have been made to solve the problem by controlling or restricting the L−R difference signal levels at high audio frequencies, but this has the effect of reducing the high frequency stereo separation at the receiver. In another system which was based on the C-QUAM TM system referenced above, the transmitted signal was a compatible quadrature signal up to a predetermined frequency and a pure quadrature signal above that frequency. This system was usable but not completely satisfactory since it resulted in distortion around the crossover frequency, and even some distortion in the high frequency quadrature signal due to the presence of the low frequency signals. In some countries, however, the best practical signal is still a compatible signal for all normal program material, but changing to pure quadrature where necessary to eliminate adjacent channel interference.

SUMMARY OF THE INVENTION

It is therefore an object of the present invention to provide an AM stereo signal which will minimize adjacent channel interference and, at the same time, minimize distortion in the received signal.

The system of the present invention provides these desired objects by filtering the cosine factor in a low pass filter in both the transmitter and the receiver. The signal thus remains the C-QUAM signal over most of the audio range with no distortion and no spectrum spreading, and becomes pure quadrature at only the higher frequencies. While there could be slight distortion of the higher frequencies in the envelope, by properly choosing the frequency limit of the filter little or no distortion will appear in existing receivers with envelope detectors and relatively narrow band IF response. At the same time, the presence of a quadrature signal at frequencies beyond the cutoff frequency of the filter ensures that only first order sidebands terms are present at the band edges of the transmitted signal.

BRIEF DISCRIPTION OF THE DRAWING

FIG. 1 is a block diagram of a transmitter according to the system of the invention.

FIGS. 2A-D are charts of waveforms and spectra relating to the system.

Figure 5A:
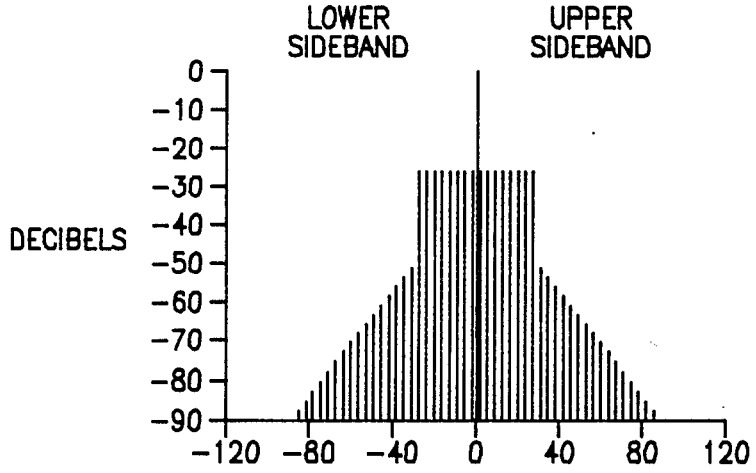

FIGS. 5A,B are spectrum charts relating to the system.

DETAILED DESCRIPTION OF THE PREFERRED EMBODIMENT

Figure 1:
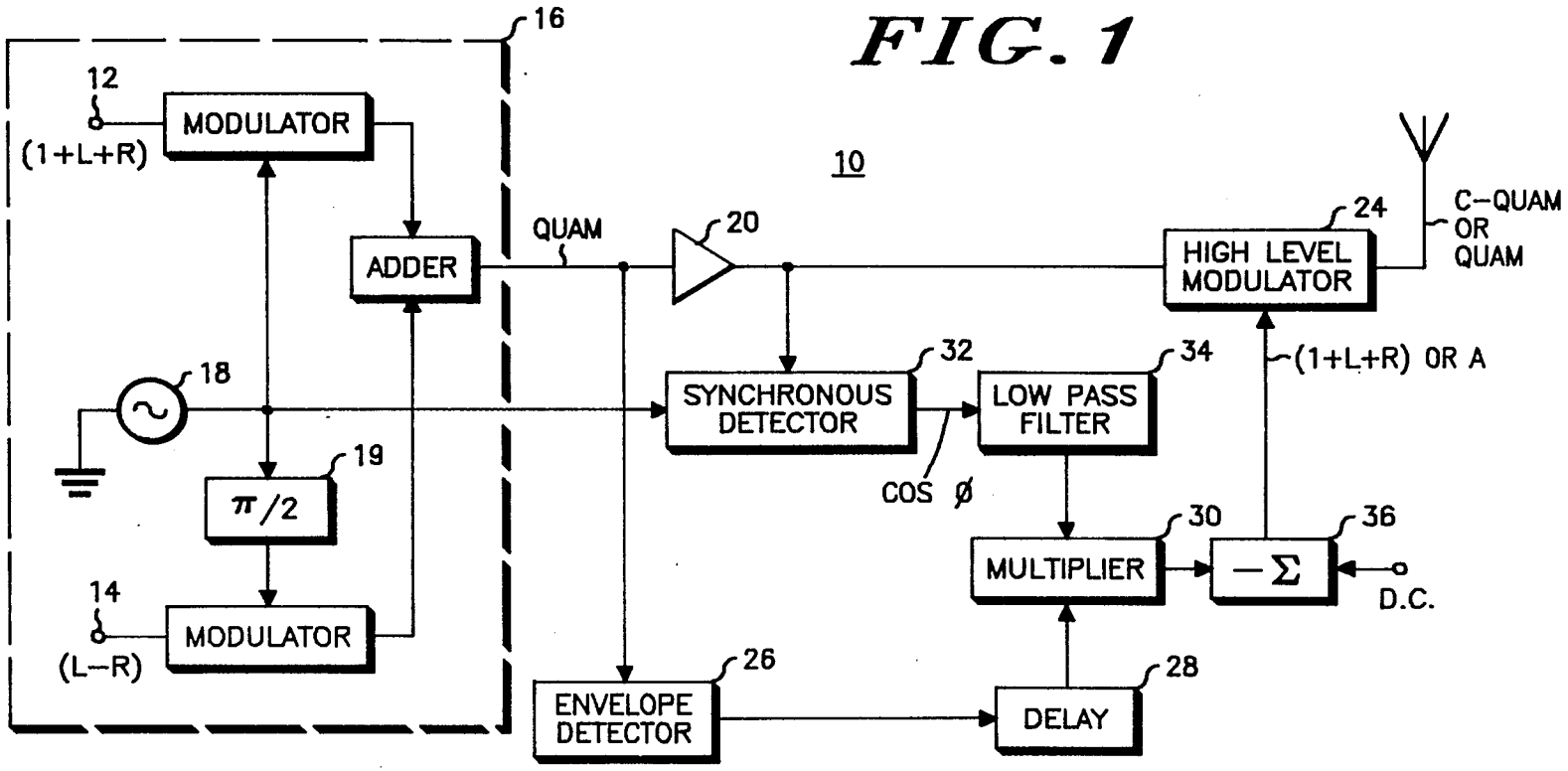
Figure 2A:
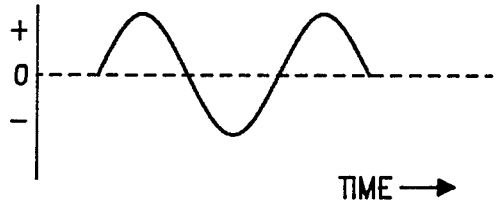
Figure 2B:
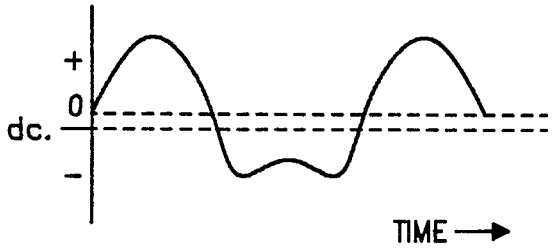
Figure 2C:
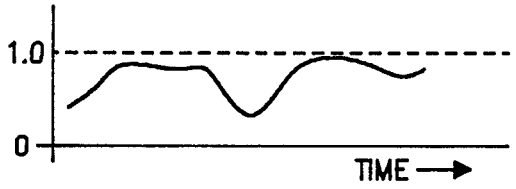
Figure 2D:
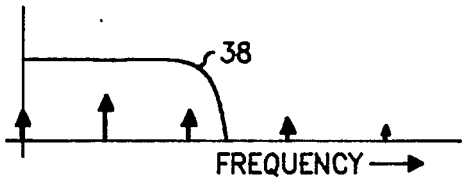

FIG. 1 is a block diagram of a transmitter 10 with two inputs 12, 14 to a quadrature amplitude modulated (QUAM) signal generator 16. An oscillator 18 and a 90° phase shifter 19 supply two carrier signals with identical frequency but in phase quadrature. The input signals at the terminals 12,14 may be two information signals such as the left (L) and right (R) signals of a stereo program or the sum and difference of those signals as shown here. If the inputs are L and R, they must be matrixed to produce the sum and difference signals. In any event, the output of the signal generator 16 will be a pure quadrature signal of the form.

$$A \cos (w_c t+\phi) \quad (1)$$

where

A is $\sqrt{(1+L+R)^2+(L-R)^2}$ and $\phi$ is arc tan [(L−R)/(1+L+R].

The output of the QUAM signal generator is coupled to a limiter 20 which removes the amplitude variations and couples the resulting phase-modulated signal to a high level transmitter 24. The Quam signal is also coupled to an envelope detector 26 and the envelope signal is coupled through a delay circuit 28 to a multiplier 30. The limiter output is also coupled to a synchronous detector 32 which receives a second input from the oscillator 18. The detector 32 output is thus cos $\phi$, ignoring the high frequency sum term. The cosine signal is then filtered in a low pass filter 34 having a corner frequency near the upper end of the usual program material audio frequencies; e.g. 3 to 6 kHz. Another way of describing the filter 34 is that it multiplies the cosine signal input by a frequency-dependent function f(w) having two values, 1 and 0.

The filtered cosine signal is coupled to a second input of the multiplier 30. The multiplier output thus varies from 1+L+R for most program material, to the signal A as given above in the most extreme case of high frequency, high modulation L−R programming. The multiplier 30 output is coupled to an adder circuit 36, where it is combined with a D.C. signal which may be derived from the QUAM output of the envelope detector 26. The adder 36 output is coupled to the high level transmitter 24 for amplitude modulating the phase modulated signal from the limiter 20.

The charts of FIG. 2 will help explain the purpose of the filter 34. It is here assumed that the intelligence signal to be transmitted is a simple sine wave as shown in FIG. 2A and that the signal is sent mainly in either the right or left channel. When significant stereo is present the L−R signal provides a modulating signal similar to that described by A in equation (1). Even though the original audio signal is a simple sine wave the signal A may require significant distortion as shown in FIG. 2B. The signal of FIG. 2B can be derived from an envelope detector such as the one shown at 26 of FIG. 1, and when this signal is sent directly to the audio input of the transmitter the transmitter transmits a pure quadrature signal. If the envelope signal of FIG. 2B is multiplied by the cosine function of FIG. 2C which has a spectrum shown in Fig. 2D, the original audio signal of FIG. 2A is recovered, and when this signal is used to modulate the transmitter a compatible quadrature signal is transmitted. At low audio frequencies all terms of the cosine function pass through the filter 34, as may be seen in the curve 38 of FIG. 2D. The original audio signal is thus recovered from the envelope signal and used to modulate the transmitter to provide a broadcast signal with compatible envelope. At high frequencies of the audio signal where it is desired that the signal switch to a quadrature signal, only the DC term of the cosine signal passes through filter 34. This translates the envelope signal to the audio input of the transmitter without altering the waveform and results in the transmission of a quadrature signal at high audio frequencies.

Figure 3:
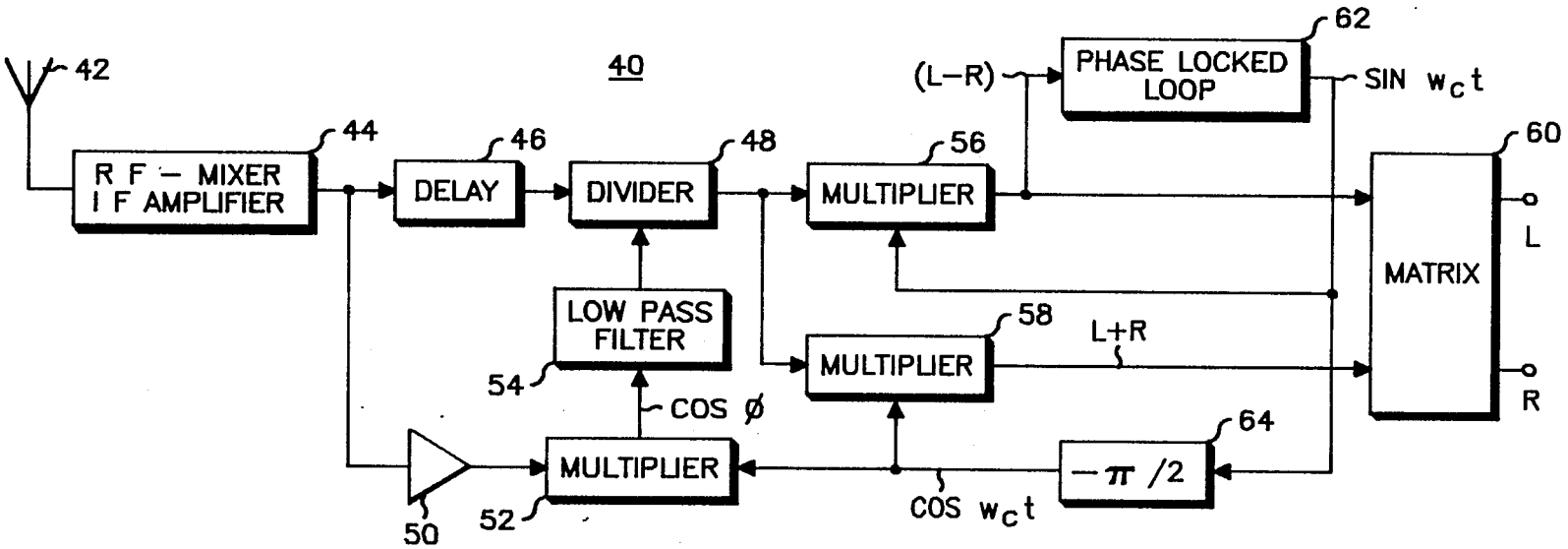
FIG. 3 is a block diagram of a receiver for the system.

FIG. 3 shows a receiver embodiment 40 for use in the system of the invention. The transmitted signal is received at an antenna 42 and processed in the usual fashion in RF/mixer/IF stages 44. The IF signal is coupled to a delay circuit 46 as needed and the delayed signal is coupled to a divider 48. The IF signal is also coupled to a limiter 50 which removes the amplitude variations and provides an output to a first multiplier 52. The first multiplier is also termed an in-phase detector. As will be seen, the multiplier receives a carrier frequency signal at a second input so that the output of the multiplier is cos $\phi$. The cos $\phi$ signal is coupled to a lowpass filter 54 which corresponds to the filter 34 of the transmitter 10.

The filtered cosine signal is coupled to the divider 48 for correction of the delayed IF signal. The divider output is coupled to second and third multipliers 56,58 with normal outputs of (L−R) and (L+R), respectively. These two output signals, when coupled to a matrix 60 produce audio outputs of L and R, representing the two original intelligence signals at the inputs of the transmitter 10. The L−R signal is also coupled to a phase locked loop 62 which, as is known, can output a sin $w_c t$ signal to the multiplier 56 and, with a $-\pi/2$ phase shifter 64, a cos $w_c t$ signal to the multiplier 58.

Figure 4:
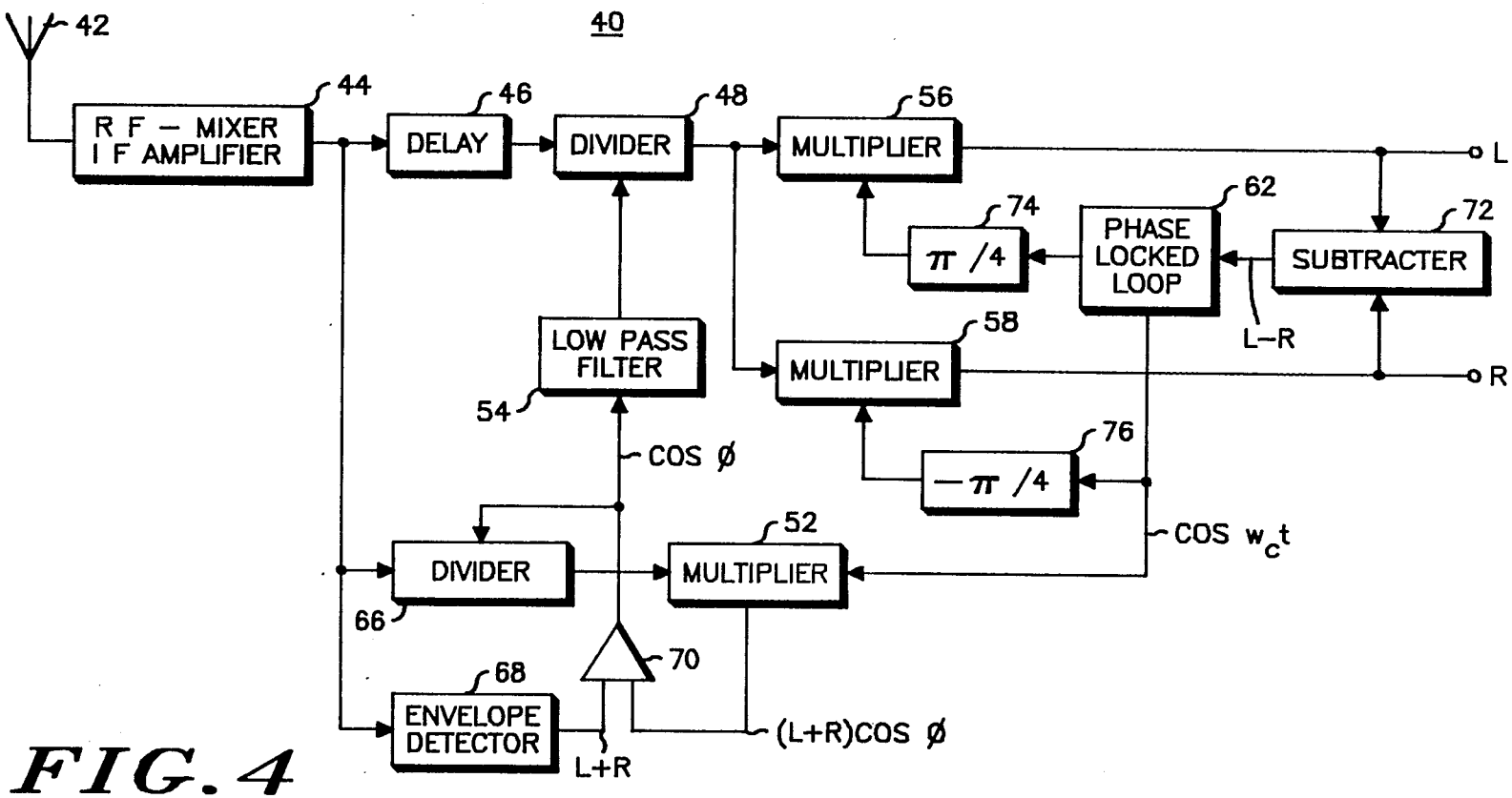
FIG. 4 is a second embodiment of a receiver for the system.

The receiver of FIG. 4 is a somewhat different embodiment, but uses the same principle of filtering the cosine correction signal. As will be seen, the correction signal itself is derived in essentially the same way as in U.S. Pat. No. 4,371,747, assigned to the assignee of the present invention. The AM stereophonic signal is received at the antenna 42, processed in the RF/mixer/IF stages 44 and delayed as necessary in the delay circuit 46. The delayed signal is coupled to the divider 48. The IF signal is also coupled to a second divider 66 and to an envelope detector 68. The envelope detector output signal (L+R) is coupled to a comparator 70 which also receives (L+R)cos $\phi$ from the multiplier 52. The output of the comparator 70, cos $\phi$, is coupled back to the divider 66 and to the filter 54. In the divider 66 the IF signal is divided by the cos $\phi$ signal and the resulting signal is multiplied by the cos $w_c t$ signal from the PLL 62. The L−R input for the PLL is derived from the L and R outputs of the multipliers 56,58, coupled through a subtracter 72. The PLL output is phase shifted in a $\pi/4$ phase shifter 74 and coupled to the multiplier 56, and also phase shifted in a $-\pi/4$ phase shifter 76 and coupled to the multiplier 58, thus providing the L and R outputs as noted above without matrixing.

Figure 5B:
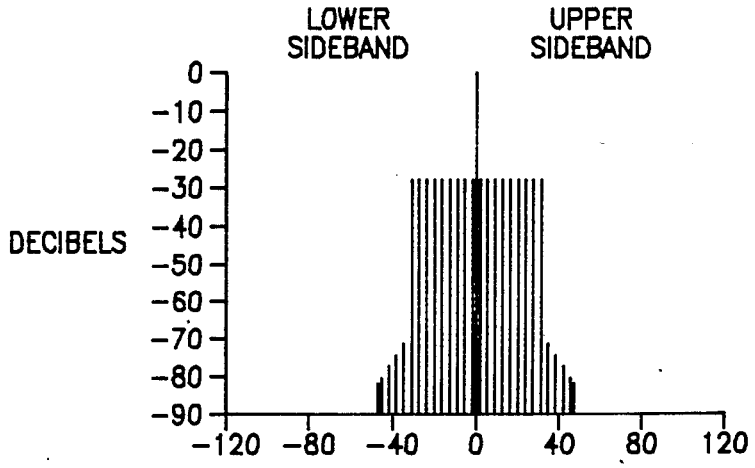

FIG. 5A shows in simplified form the spectrum of a broadcast signal with unfiltered cosine correction signal. As seen, the higher order sidebands are down considerably from the first order sidebands, but could conceivably cause a problem with a high frequency, high level signal in one channel only. FIG. 5B illustrates the effect of putting a lowpass filter in the cosine signal path, bringing the higher order sidebands down still further. Thus, any possibility of adjacent channel interference has been eliminated.

There has been shown and described an AM stereophonic system which effectively prevents adjacent channel interference while not causing objectionable distortion or a noticeable effect from switching modes in the transmitter or receiver. In the transmitter the cosine correction signal is filtered in a lowpass filter to remove its upper sidebands. Existing receivers will only rarely detect a small amount of distortion due to this modification. New receivers can filter the cosine correction signal to compensate for the new signal, and will have no added distortion.

What is claimed is:

1. A transmitter for providing a compatible AM stereophonic signal requiring a correction signal and comprising:

input means for receiving two information signals;

first modulator means for providing a quadrature signal which is phase modulated by an angle whose tangent is the ratio of the difference between the two information signals to one plus the sum of said signals;

circuit means for determining the angle of modulation of said quadrature signal and providing a correction signal proportional to the cosine of said angle;

lowpass filter means coupled to filter said correction signal;

circuit means for extracting the sum of said two information signals from said quadrature signal;

multiplier means for multiplying said sum signal by said filtered correction signal; and second modulator means coupled to modulate the output of said first modulator means by the output of said multiplier means.

2. A transmitter in accordance with claim 1 wherein said two information signals are the left and right signals of a stereophonic program.

3. A transmitter in accordance with claim 1 wherein said first modulator means includes combining means coupled to the input means for providing sum and difference signals from said information signals, carrier frequency means for providing two carrier signals of the same frequency and in phase quadrature with each other, modulation means for modulating said carrier signals with said sum and difference signals respectively and combining the modulated carriers, and means for removing the amplitude modulation on the combined signal.

4. A transmitter in accordance with claim 1 wherein said lowpass filter means has a corner frequency lower than the highest audio frequency transmitted.

5. A transmitter in accordance with claim 1 wherein said second modulator means includes high level modulation and amplification means.

6. A transmitter for providing a compatible AM stereophonic signal and comprising:

input means for receiving two information signals;

combining means coupled to the input means for providing sum and difference signals from said information signals;

carrier frequency means for providing two carrier signals of the same frequency and in phase quadrature with each other;

first modulation means for modulating said carrier signals with said sum and difference signals respectively and combining the modulated carriers;

second modulation means for providing a high level output signal;

means for removing the amplitude modulation on the combined signal and coupling the resulting phase modulated signal to the second modulation means;

circuit means for determining the angle of modulation of said combined signal and providing a signal proportional to the cosine of said angle;

lowpass filter means coupled to filter said cosine porportional signal; and multiplier means for multiplying said sum signal by said filtered cosine signal and coupling the multiplied signal to said second modulation means.

7. An AM stereophonic receiver comprising:

input means for receiving a compatible AM stereophonic signal including two information signals;

means for providing a correction signal;

lowpass filter means for filtering said correction signal;

means for receiving said filtered correction signal and correcting said received stereophonic signal therewith.

8. An AM stereophonic receiver in accordance with claim 7 wherein said lowpass filter means has a corner frequency lower than the highest audio frequency transmitted.

9. An AM stereophonic receiver in accordance with claim 7 and further including demodulating means for receiving the corrected signal and deriving therefrom said two information signals.

10. An AM stereophonic receiver in accordance with claim 7 and further including demodulating means for receiving the corrected signal and deriving therefrom the sum and difference of said two information signals and matrixing means for obtaining the two information signals.

11. An AM stereophonic receiver in accordance with claim 7 and wherein the input means includes means for translating the received signal to an intermediate frequency signal.

12. An AM stereophonic receiver in accordance with claim 7 and wherein the means for providing a correction signal includes means for limiting the amplitude of the received signal and means for multiplying the limited signal by a carrier frequency signal.

13. An AM stereophonic receiver in accordance with claim 7 and wherein the means for providing a correction signal includes means for comparing the envelope of the received signal with the in-phase component of said received signal signal to derive the correction signal.

14. An AM stereophonic receiver in accordance with claim 13 and wherein the means for providing a correction signal includes means for dividing the received signal by the correction signal and multiplying the quotient by a carrier signal to derive the in-phase component of said received signal signal.

15. An AM stereophonic receiver in accordance with claim 7 and further including demodulating means for receiving the corrected signal and deriving therefrom said two information signals, the demodulating means including means for providing carrier frequency signals.

16. An AM stereophonic receiver in accordance with claim 15 wherein the means for providing carrier frequency signals includes a phase locked loop (PLL) and phase shifting means for shifting the phase of the PLL output signal to provide two carrier frequency signals in phase quadrature with each other.

17. An AM stereophonic receiver in accordance with claim 16 and including a subtracter circuit coupled to provide the difference signal of the two information signals, and wherein the input signal of the PLL is said difference signal.

18. A system for transmitting and receiving a compatible AM stereophonic signal requiring a correction signal, the transmitter comprising:

input means for receiving two information signals;

first modulator means for providing a quadrature signal which is phase modulated by an angle whose tangent is the ratio of the difference between the two information signals to one plus the sum of said signals;

first circuit means for determining the angle of modulation of said quadrature signal and providing a correction signal proportional to the cosine of said angle;

first lowpass filter means coupled to filter said correction signal;

circuit means for extracting the sum of said two information signals from said quadrature signal;

multiplier means for multiplying said sum signal by said filtered correction; and second modulator means including high level modulation and amplificaiton means and coupled to modulate the output of said first modulator means by the output of said multiplier means; and the receiver comprising:

second input means for receiving the transmitted stereophonic signal;

second circuit means for deriving the correction signal;

second lowpass filter means for filtering said correction signal, said second filter means being essentially identical to said first filter means;

means for receiving said filtered correction signal and correcting said received stereophonic signal therewith; and demodulating means for receiving the corrected signal and deriving therefrom said two information signals.

* * * * *